US011732984B2

(12) United States Patent
Ayotte et al.

(10) Patent No.: US 11,732,984 B2
(45) Date of Patent: Aug. 22, 2023

(54) SLIDE-INSTALLED FEED TRAY FOR BELT-FED WEAPON

(71) Applicant: Textron Systems Corporation, Hunt Valley, MD (US)

(72) Inventors: Kevin Michael Ayotte, Acworth, GA (US); Benjamin Tyler Cole, Baltimore, MD (US); Leonard Terrence Katilas, Essex, MD (US)

(73) Assignee: Textron Systems Corporation, Hunt Valley, MD (US)

( * ) Notice: Subject to any disclaimer, the term of this patent is extended or adjusted under 35 U.S.C. 154(b) by 0 days.

(21) Appl. No.: 17/691,571

(22) Filed: Mar. 10, 2022

(65) Prior Publication Data

US 2022/0341689 A1 Oct. 27, 2022

Related U.S. Application Data

(60) Provisional application No. 63/159,614, filed on Mar. 11, 2021.

(51) Int. Cl.
*F41A 9/29* (2006.01)
*F41A 3/66* (2006.01)

(52) U.S. Cl.
CPC . *F41A 9/29* (2013.01); *F41A 3/66* (2013.01)

(58) Field of Classification Search
USPC ..... 89/33.02
See application file for complete search history.

(56) References Cited

U.S. PATENT DOCUMENTS

| | | | | |
|---|---|---|---|---|
| 6,634,274 | B1 | 10/2003 | Herring | |
| 8,136,440 | B1 | 3/2012 | Shirts et al. | |
| 9,488,425 | B2 | 11/2016 | Delury et al. | |
| 9,879,931 | B2 | 1/2018 | Patel | |
| 10,180,296 | B2 | 1/2019 | Polston | |
| 11,268,774 | B1 * | 3/2022 | Landies, III | F41A 3/66 |

* cited by examiner

*Primary Examiner* — Reginald S Tillman, Jr.
(74) *Attorney, Agent, or Firm* — BainwoodHuang

(57) ABSTRACT

A belt-fed weapon includes an upper part defining a feed tray cavity, and a feed tray in the feed tray cavity, wherein the feed tray and feed-tray cavity are co-configured for lateral sliding insertion and removal of the feed tray to and from an installed position in the feed tray cavity. The arrangement enables insertion and removal of the feed tray without interference with an installed scope or similar optic, enabling maintenance or field stripping without requiring removal or re-sighting of the scope.

5 Claims, 3 Drawing Sheets

SLIDE-INSTALLED FEED TRAY FOR BELT-FED WEAPON

STATEMENT OF GOVERNMENT RIGHTS

The invention was made with Government support under US Army contract W15QKN-19-9-1025. The Government has certain rights in the invention.

BACKGROUND

The invention is generally in the field of small arms, and relates specifically to improved feeding mechanisms for belt-fed weapons.

Some belt-fed weapons are transitioning to using more advanced optics that take up more rail space on the top rail of the weapons. Due to the size and required eye relief, there is a potential for interference between these optics and the operation of loading and clearing rounds from a belt feed tray also located at or near the top of the weapon. In conventional belt-fed weapons the feed tray assembly may be removed from a hinged joint, which potentially also removes any optics that are present on the top rail. Such removal can interfere with a previously established zero for the optics, for example. Additionally, in alternate configuration Cased Telescoped belt-fed weapons, the feed tray assembly could be mounted in such a manner that requires vertical removal of the assembly from the housing group. Potential exists for optics to interfere with the removal of the feed tray assembly in this configuration.

SUMMARY

A disclosed arrangement addresses the problem of potential interference between the feed tray and a rail-mounted optic, and/or, loss of zero retention, by employing a sliding sideways installation configuration that enables a user to remove the belt feed tray sub-assembly and field strip the weapon, without having to remove the optics, providing the advantages stated above a field stripped level. During disassembly and assembly, the feed tray assembly is installed from the shooter's left and retained in place via two vertical takedown pins. The assembly riding in tracks, in conjunction with the take down pins, constrains the belt feed assembly in all degrees of freedom.

More particularly, a belt-fed weapon is disclosed that includes an upper part defining a feed tray cavity, and a feed tray in the feed tray cavity, wherein the feed tray and feed-tray cavity are co-configured for lateral sliding insertion and removal of the feed tray to and from an installed position in the feed tray cavity. This arrangement enables insertion and removal of the feed tray without interference with an installed scope or similar optic, enabling maintenance or field stripping without requiring removal or re-sighting of the scope.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views.

DETAILED DESCRIPTION

Figure 1:
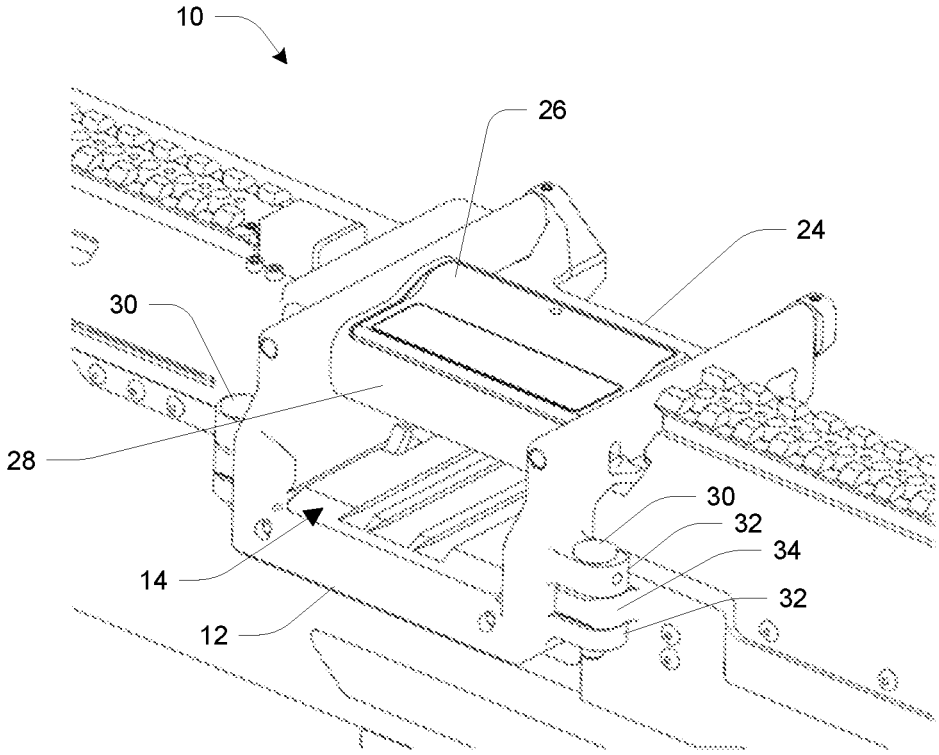
FIG. 1 is a perspective left-side view of an upper portion of a belt-fed weapon having a slide-mounted feed tray assembly.
Figure 2:
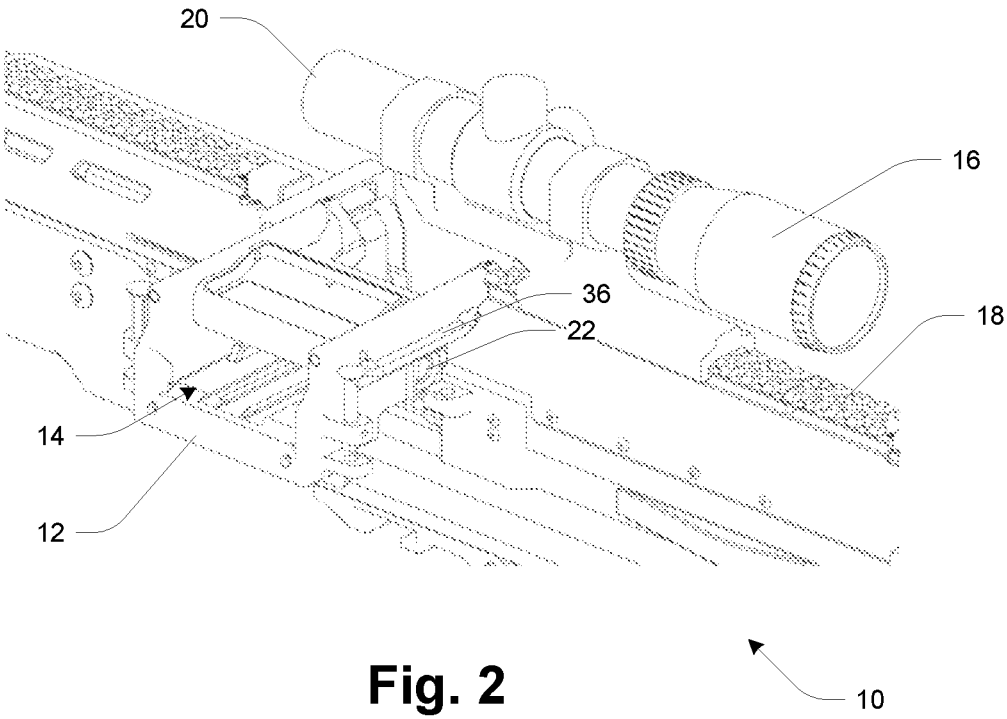
FIG. 2 is a left-side view showing the feed tray assembly during installation.
Figure 3:
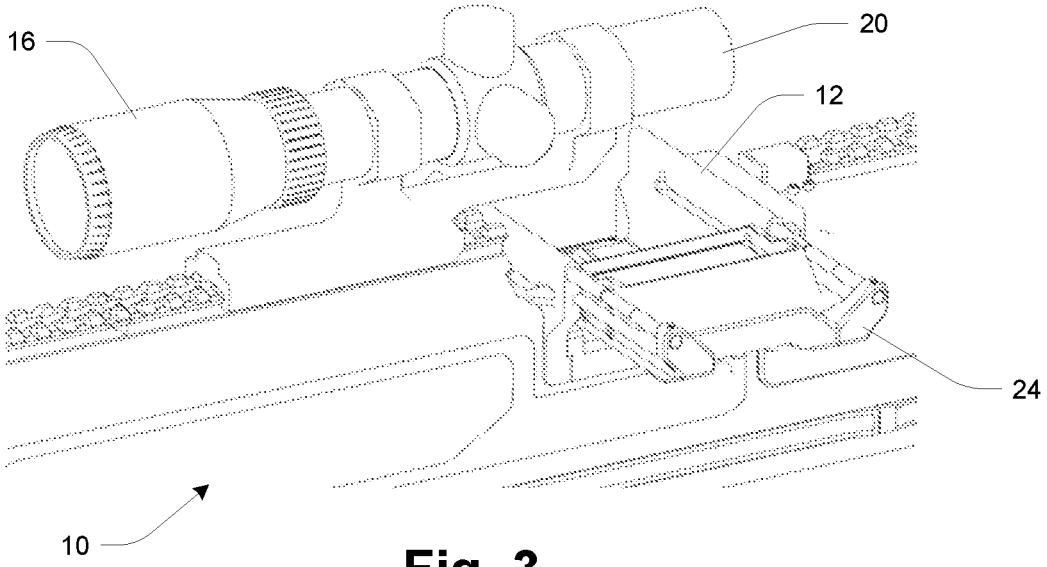
FIG. 3 is a right-side view showing a feed tray cover in open position.

FIGS. 1-3 show a middle section of a belt-fed weapon 10. FIGS. 1 and 2 are from the left side and FIG. 3 is from the right side (shooter's perspective) respectively. The weapon 10 includes a feed tray assembly, or "feed tray", 12 having a left-side lateral opening 14 for receiving a belt of ammunition (not shown). The feed tray 12 is slidably mounted in a corresponding cavity of the upper part of the weapon 10. In FIGS. 1 and 3 the feed tray 12 is fully installed, while in FIG. 2 the feed tray 12 is shown in a slightly withdrawn position, illustrating the sliding manner of installation and removal which are explained further below. As also shown the weapon 10 may include a sighting optic or "scope" 16 mounted to an upper rail 18 and having a forward portion 20 that sits directly above the feed tray assembly 12. In operation, the feed tray 12 feeds rounds or cartridges into alignment with an axial opening 22 (visible in partially withdrawn view of FIG. 2) that aligns with a firing chamber of the weapon 10, enabling the rounds to be rammed into the firing chamber and then fired, as generally known in the art.

The feed tray assembly 12 having a feed tray cover 24 which also slides laterally between open and closed positions, as described more below. The feed tray cover 24 carries a release button 26 surrounded by a shroud 28. It will be appreciated that with this arrangement the release button 26 is less sensitive to forces having a more glancing characteristic than the designed-for vertical forces of an operator's fingers depressing the release button 26 vertically downward. For example, a force delivered at an oblique (or off-axis) angle will be exerted against the shroud 28 rather than the release button 26. This aspect is elaborated further below.

FIGS. 1 and 2 show the feed tray assembly 12 in-place and during installation, respectively. The feed tray assembly 12 is installed by being slid into the weapon 10 from the left side, toward the right, with the feed tray cover 24 in the closed position. The right-side view of FIG. 3 shows the feed tray assembly 12 fully installed, with the feed tray cover 24 in the open (extended) position. The lateral opening/closing motion of the feed tray cover 24 means that the feed tray 12 can be opened and closed without any mechanical interference with the forward portion 20 of the scope 16.

The feed tray assembly 12 is retained in place via two vertical takedown pins 30 that extend through retention knuckles 32, 34 (of feed tray 12 and weapon body respectively). A detent feature is preferably included to retain the takedown pins 32 in the retaining position (fully inserted downwardly). The feed tray 12 has shoulder portions 36 that ride in corresponding slots or tracks of the weapon body to locate and retain the belt feed assembly in all positions. This configuration allows the user to remove the feed tray 12 and field strip the weapon without having to remove the scope 16, continuing to provide advantages as outlined above, at a field stripped level. This feature may also be used during normal maintenance.

Figure 4:
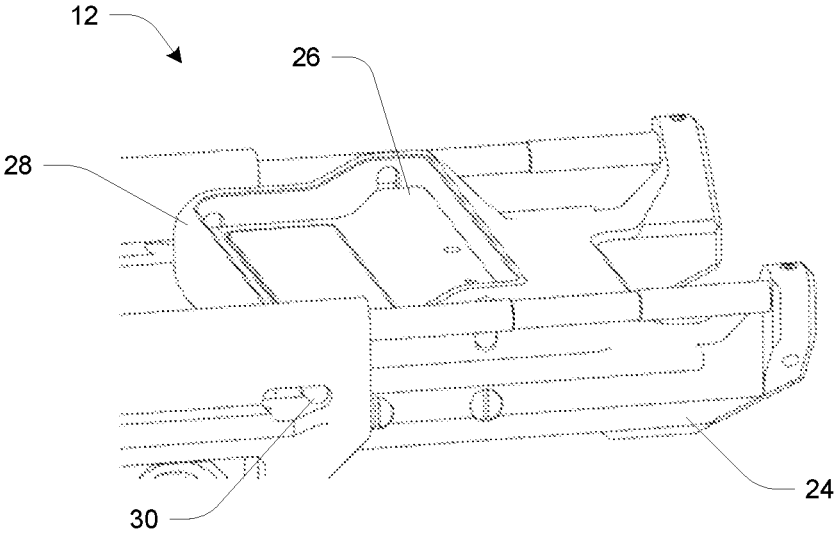
FIG. 4 is a perspective view of a portion of the feed tray assembly with feed tray cover in open position.

FIG. 4 shows additional details of the sliding feed tray cover 24, which is shown in fully open position (extended to shooter's right). It includes the button 26 for opening/closing (shown depressed in the open or release position) and the surrounding shroud 28 that protects against inadvertent unlocking. The feed tray cover 24 is maintained in the closed or locked position by a cross pin 30 that is spring loaded in an upward direction. When the user pushes down on the release button 26, it depresses the cross pin 30 which is then free to move in a cam path to the shooter's right, so the feed tray cover 24 is considered unlocked. As the feed tray cover 24 is slid right, it extends out and uncovers the space in the bottom of the feed tray 12 to enable a user to extract cartridges or to load a new belt. When the feed tray cover 24 is closed (slid back left), the cross pin 30 reaches a point at which it is allowed to spring upwards to a locked position, preventing cover motion (see description of FIGS. 5 and 6 below). This sliding configuration enables the user to simply open the feed tray cover 24 and load new rounds without having to adjust the position of the scope 16 or lose sight picture. This system also allows the scope 16 to stay zeroed on the weapon body, since the top rail is fixed to the weapon body and not on a separate hinging mechanism.

In one embodiment, the feed tray cover 24 may be moved completely manually in both directions. Alternatively, it may be spring loaded in one direction (either open or closed), and a manual operation used to move it in the opposite direction.

Figure 5:
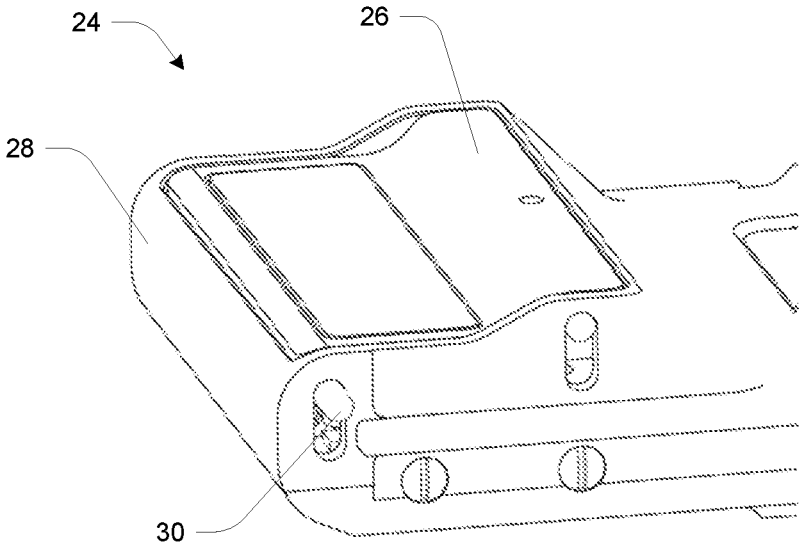
FIGS. 5 and 6 are perspective views of the feed tray cover showing release button in non-release (upward) and release (downward) positions respectively.
Figure 6:
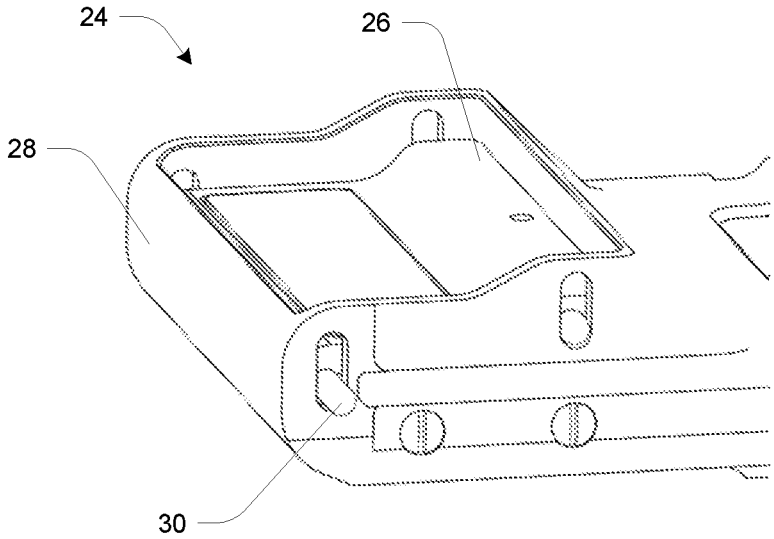

FIGS. 5 and 6 illustrate configuration and operation of the release button 26 in additional detail. FIGS. 5 and 6 show the feed tray cover 24 with release button 26 in upward (locked) position and downward (unlocked/open) position respectively. As mentioned, the shrouding of the button protects against inadvertent opening of the feed tray cover, especially during operation of the weapon. The shroud 28 forms a well-like space in which the release button 26 travels vertically, thus limiting the effective forces to those that act vertically on the release button 26 without also acting on the surrounding shroud 28. Also visible in these Figures is the cross pin 30 that is moving between an upward (locked) position (FIG. 5) and a downward (unlocked) position respectively, as described above with reference to FIG. 4.

While various embodiments of the invention have been particularly shown and described, it will be understood by those skilled in the art that various changes in form and details may be made therein without departing from the scope of the invention as defined by the appended claims.

What is claimed is:

1. A belt-fed weapon, comprising:

an upper part defining a feed tray cavity; and a feed tray in the feed tray cavity, wherein the feed tray and feed-tray cavity are co-configured for lateral sliding insertion and removal of the feed tray to and from an installed position in the feed tray cavity, wherein the feed tray has shoulder portions that ride in corresponding tracks of the upper part to locate and enable the lateral sliding insertion and removal of the feed tray, and wherein the feed tray has retention knuckles at outer ends of the shoulder portions, the retention knuckles becoming aligned with corresponding retention knuckles of the upper part when the feed tray is in the installed position and configured to receive respective vertical takedown pins to retain the feed tray in the installed position in the feed tray cavity.

2. The belt-fed weapon of claim 1, further including a scope to the upper part and having a forward portion directly above the feed tray in the feed tray cavity.

3. The belt-fed weapon of claim 1, wherein the feed tray includes a feed tray cover configured for lateral sliding opening and closing movement, the feed tray cover having (1) a closed position in which it covers a bottom feed tray portion to retain a belt of ammunition during operation, and (2) an open position laterally displaced from the closed position to enable insertion of the belt of ammunition in the feed tray.

4. The belt-fed weapon of claim 3, wherein the feed tray cover includes a release button enabling an operator to unlock the feed tray cover in the closed position and move the feed tray cover to the open position.

5. The belt-fed weapon of claim 3, wherein the feed tray cover includes a shroud portion surrounding the release button to protect against inadvertent activation of the release button by off-axis forces.

* * * * *